United States Patent [19]

Mayes

[11] Patent Number: 4,521,029

[45] Date of Patent: Jun. 4, 1985

[54] ICEBOARD

[76] Inventor: Thomas L. Mayes, 3913 South Rd., Chesapeake, Va. 23321

[21] Appl. No.: 390,971

[22] Filed: Jun. 22, 1982

[51] Int. Cl.[3] ..... A63C 17/18

[52] U.S. Cl. ..... 280/7.14; 280/12 H; 280/16; 280/87.04 A

[58] Field of Search ..... 280/16, 12 H, 7.13, 280/7.14, 11.18, 11.15, 11.17, 14, 87.04 A, 87.04 R

[56] References Cited

U.S. PATENT DOCUMENTS

| | | | |
|---|---|---|---|
| 396,413 | 1/1889 | McQuown | 280/11.15 |
| 2,814,811 | 12/1957 | Ritter | 280/16 |
| 3,026,119 | 3/1962 | Bauer | 280/11.18 |
| 3,030,123 | 4/1962 | Dworak | 280/16 |
| 3,203,706 | 8/1965 | Boyden | 280/87.04 A |
| 4,043,565 | 8/1977 | Mogannam | 280/11.12 |
| 4,114,913 | 9/1978 | Newell et al. | 280/12 H |
| 4,116,455 | 9/1978 | Dotson et al. | 280/7.12 |
| 4,138,128 | 2/1979 | Criss | 280/16 |
| 4,165,091 | 8/1979 | Chadwick | 280/12 H |
| 4,194,753 | 3/1980 | Schrishuhu, Jr. | 280/13 |
| 4,221,394 | 9/1980 | Campbell | 280/12 H |
| 4,225,145 | 9/1980 | Carr | 280/12 H |

FOREIGN PATENT DOCUMENTS

| | | | |
|---|---|---|---|
| 2746270 | 4/1978 | Fed. Rep. of Germany | 280/11.28 |
| 2411117 | 8/1979 | France | 280/7.14 |

*Primary Examiner*—David M. Mitchell

*Attorney, Agent, or Firm*—Lane, Aitken & Kananen

[57] ABSTRACT

A skateboard for ice, or iceboard, includes pairs of skates mounted for unrestrained pivotal movement about axles extending laterally from trucks depending from an iceboard platform. Each skate has a protrusion extending upwardly a distance sufficient to engage a forward portion of the platform to prevent the forward portion from engaging the ice, and a bumper guard is mounted on each protrusion.

9 Claims, 4 Drawing Figures

ICEBOARD

BACKGROUND OF THE INVENTION

In the field of skateboarding on ice, there is a need for providing an ice skateboard, or iceboard, which has runner mounts permitting the runners to move with respect to the board to give the rider the flexibility and freedom of motion to perform the various feats which are popular among skateboarders, while providing the rider with close control over the iceboard and avoiding the type of excessive pitching which would cause the rider to fall.

It is a problem with existing skateboards designed for ice, that they provide no relative movement between the runners and the board which would allow the rider to do various tricks, while maintaining the runners in contact with the ice. Other problems with existing skateboards are that they fail to provide the rider with a cushioned ride, or the blades are such that they fail to track positively on the ice, or the blades are not conveniently sharpenable, or all three.

For example, U.S. Pat. No. 4,114,913 to Newell et al discloses a skateboard having front and rear pairs of narrow runners or blades in which the edges on one of the pairs are less sharp than the edges on the other pair, so that one end of the board slides relative to the other. In addition, the Newell et al patent discloses blades having limited movement about a horizontal axis, but discloses no mechanism for preventing excessive pitching so that, for example, the nose of the board is prevented from engaging the ice and stopping the board, thereby spilling the rider.

SUMMARY OF THE INVENTION

It is an overall object of the invention to provide an ice skateboard, or iceboard, which provides free movement between ice-contacting runners and the board, while maintaining full contact between the runners and the ice and limiting the extent of the free movement to prevent the board from pitching forward and engaging the ice.

More particularly, it is an object of the present invention to provide an iceboard having runners, mounted in pairs, wherein each runner is freely and independently pivotable around a horizontal axis.

It is a further object of the present invention to provide a mechanism for limiting the extent of pivoting about the axis for each runner.

It is also an object of the present invention to provide runners which are quickly sharpenable by standard sharpening apparatus, such as the apparatus used for sharpening ice skates.

It is yet another object of the present invention to provide safety devices at the ends of the runners to prevent the rider from incurring cuts.

These and other objects of the present invention will become apparent from a review of the written description of the invention which follows and the brief description of the drawings.

Directed to achieving the aforestated objects and overcoming the problems of the prior art, this invention relates to an iceboard having a pair of trucks secured to the bottom of a platform, the trucks including threaded axles extending laterally from each side thereof. A skate housing, along which is secured a runner, includes a transverse tube which is press fit in place over a resilient bushing received on each laterally extending portion of the threaded axles. An arrangement of nuts and washers engages the ends of the bushings and prevents lateral movement of the skate housings, but does not significantly restrain the pivotal movement of the skate housing or runner.

Each runner includes an upwardly extending protrusion which is covered by a bumper guard of resilient material for engaging the underside of the board, thereby limiting the pivotal movement of the runners and preventing the board from pitching forward and engaging the ice. A resilient bumper guard also covers the rear end of each runner to prevent the rider from incurring cuts or other injuries on the sharp rear edges of the runners and also serves to prevent the buildup of ice and the spray of granulated ice particles.

The configuration of the runners is similar to the configuration of ice skate blades, so that the runners are conveniently sharpenable by standard ice skate sharpening apparatus.

These and other details of the construction of the apparatus according to the invention will become apparent from a written description of the invention which follows taken in conjunction with the accompanying drawings.

DETAILED DESCRIPTION OF THE PREFERRED EMBODIMENT

Figure 1:
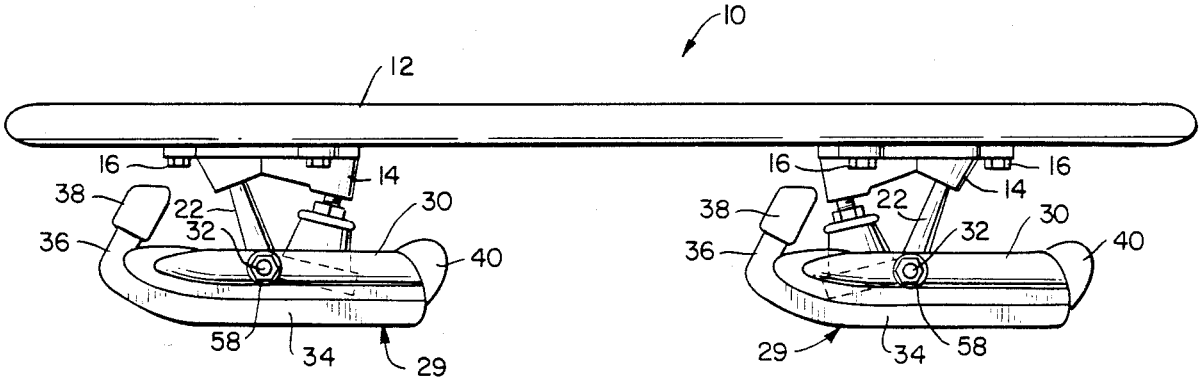
FIG. 1 is a side elevation of the iceboard according to the present invention.
Figure 2:
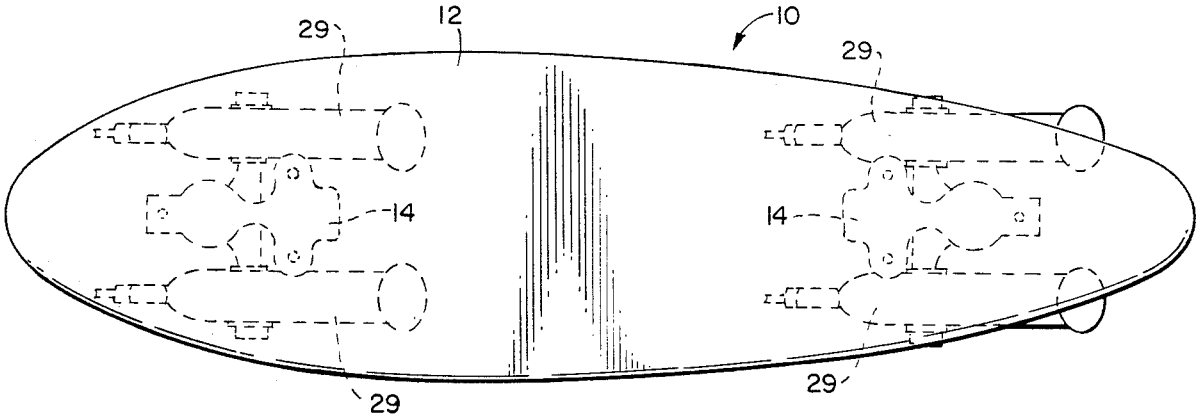
FIG. 2 is a plan view of the iceboard of FIG. 1.
Figure 3:
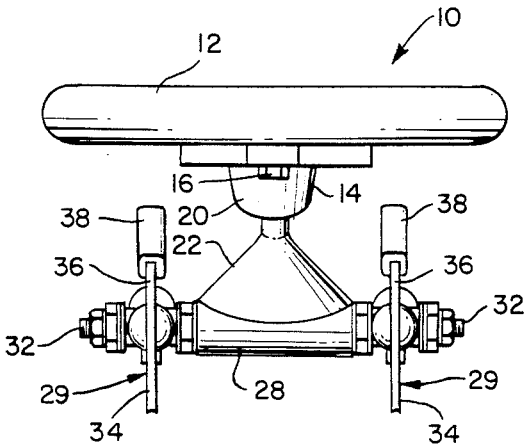
FIG. 3 is a left end view of the iceboard of FIG. 1.

As is illustrated in FIGS. 1–3, the iceboard according to the present invention, which is generally designated by the reference numeral 10 includes a rider-supporting platform 12 of any suitable material, such as wood, plastic or metal. A pair of trucks 14 are secured to the bottom of the platform 12 by fasteners 16, such as screws or rivets. The trucks 14 are conventional and, as can better be seen from FIG. 4, they may include a mounting plate 18, a resilient sleeve (not shown) in a boss 20 depending from the mounting plate 18, a shank 22 received for cushioned reciprocation in the boss 20, and a second resilient sleeve 24 mounted around a threaded support post 26 to provide the truck 14 with resilient cushioning in another direction. The shank 22 and the second resilient sleeve 24 are mounted on a common member 26 which includes a transversely extending tubular portion 28.

A pair of skates 29 including skate housings 30 are mounted on each of the trucks 14 and are freely pivotable about a threaded transverse horizontal axle 32, as will be described hereinafter. A runner 34 is secured to each skate housing 30 for tracking on ice. The forward end of each skate 34 includes an upwardly extending protrusion 36 on which is mounted a resilient bumper guard 38. The bumper guard 38 has a flat surface which engages the bottom of the platform 12 when the platform 12 pitches forward with respect to the skate 29. The protrusions 36 on the front skates 29 extend to a height sufficient to engage the bottom of the platform 12 before the front end or nose of the platform 12 engages the ice and stops suddenly, causing the rider to fall. The bumper guards 38 also serve to cover the sharp edges of the protrusions 36 and protect the rider from cuts and other injuries. A bumper guard 40 having a bulbous configuration is secured over the rear end of each runner 34, thereby protecting the rider from the sharp edges in that region, preventing the buildup of ice on the runner 34 and reducing the spray of granulated ice particles from the runner.

Figure 4:
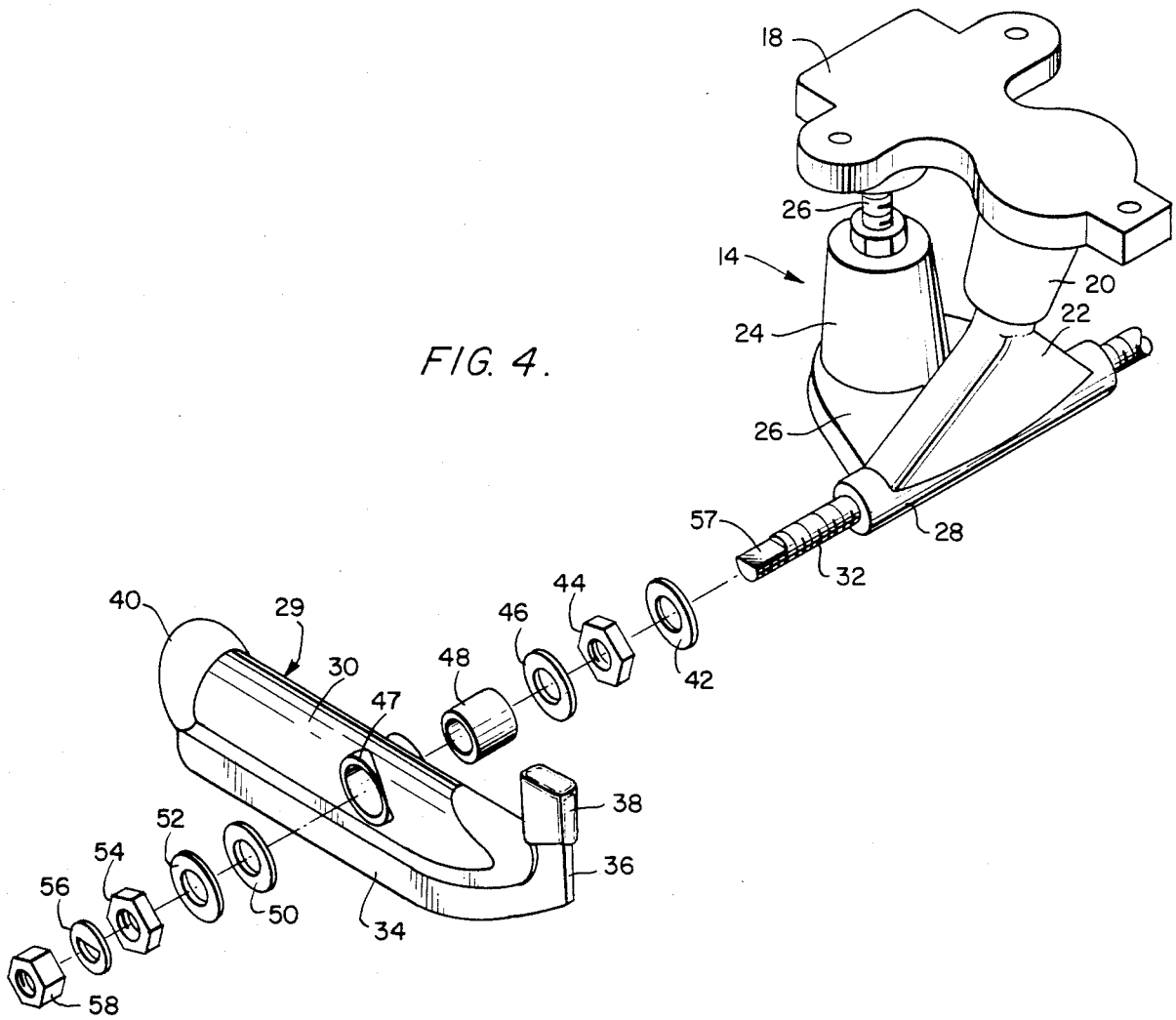
FIG. 4 is an enlarged, exploded perspective view of a runner and truck mounted on the iceboard.

As can best be seen from FIG. 4, one of the threaded axles 32 is received in the transverse tubular portion 28 of each truck 14, from which the threaded axle 32 extends laterally to each side of the truck 14. On each lateral extension of the threaded axle 32, a lock washer 42 is positioned adjacent to the end of the tubular portion 28 and is engaged by a self-locking hex nut 44, followed by a washer 46 of polytetrafluoroethylene or similar bushing material. The skate housing 30 includes a transverse tube 47 which snugly receives a bushing 48 of polytetrafluoroethylene or similar resilient, self-lubricating characteristics in a press fit. The skate 29, with the bushing 48 fit therein, is placed on the threaded axle 32 so that it abuts the washer 46 and is engaged by another polytetrafluoroethylene washer 50, a lock washer 52, a self-locking nut 54, a key lock washer 56, which cooperates with a flat surface 57 defined in the end of the lateral extension of the axle 32, and a final self-locking nut 58. Thus, the bushing 48 is engaged by washer and nut assemblies on both sides and held firmly in place. The transverse tube 47 of the skate housing 30 has an axial length substantially equal to the axial length of the bushing 48, and the washer and nut assemblies are self-locking, so that they prevent the skate housing 30 from moving laterally while permitting it to freely rotate on the bushing 48. Moreover, each skate 29 is capable of pivoting around the axle 32 independently of all of the other skates 29.

This invention may be embodied in other specific forms without departing from its spirit or essential characteristics. The present embodiment is, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. An iceboard comprising:

a platform, a pair of trucks depending from the underside of the platform, an axle extending laterally from each side of each truck, a pair of skates, each having an ice-engaging pivotal movement about the axles, and means for mounting said skates for unrestrained pivotal movement about the axles, said mounting means including for each of said skates, a transverse tube defined in a skate housing for receiving a bushing therein; a bushing having an axial length substantially equal to the axial length of said transverse tube and sized at its interior for receiving an axle therethrough, and means for pivotally securing said skate to said axle for free pivotal movement about said axle while preventing the skate from moving laterally along the axial length of said axle;

wherein one of the trucks depends from a forward portion of the platform, and each of the skates associated with the forward truck has a protrusion which extends upwardly to a height such that the upper terminus of said protrusion engages the forward portion of said underside of the platform as the skates pivot around the axle and prevent the forward portion of the platform from engaging the ice.

2. An iceboard comprising:

a platform, a pair of trucks depending from the underside of the platform, an axle extending laterally from each side of each truck, a pair of skates, each having an ice-engaging pivotal movement about the axles, and means for mounting said skates for unrestrained pivotal movement about the axles, said mounting means including for each of said skates, a transverse tube defined in a skate housing for receiving a bushing therein; a bushing having an axial length substantially equal to the axial length of said transverse tube and sized at its interior for receiving an axle therethrough, and means for pivotally securing said skate to said axle for free privotal movement about said axle while preventing the skate from moving laterally along the axial length of said axle;

wherein each of the skates has a protrusion extending upwardly so that the upper terminus of the protrusion engages the underside of the platform, thereby limiting the extent of the pivotal movement of the skates.

3. The iceboard according to claim 1 or claim 2 wherein the pivotally securing means comprises self-locking assemblies of nuts and washers cooperating with the axles.

4. An iceboard comprising:

a platform;

a pair of trucks depending from the platform, wherein one of the trucks depends from a forward portion of the platform;

an axle extending laterally from each side of each truck;

a pair of skates, each having an ice-engaging runner, associated with each truck, wherein each of the skates associated with a forward truck has a protrusion extending upwardly a distance sufficient to engage the forward portion as the skates pivot around the axle and prevent the forward portion from engaging a surface on which said runner engages;

a guard mounted on each protrusion; and means for mounting said skates for unrestrained pivotal movement about the axles.

5. The iceboard according to claim 4, wherein each of the skates has a protrusion extending upwardly to engage the platform, thereby limiting the extent of the pivotal movement of the skates.

6. An iceboard comprising:

a platform;

a pair of trucks depending from the platform;

an axle extending laterally from each side of each truck;

a pair of skates, each having an ice-engaging runner, associated with each truck and a protrusion extending upwardly to engage the platform, thereby limiting the extent of pivotal movement of the skates;

a guard mounted on each protrusion; and means for mounting said skates for unrestrained pivotal movement about the axles.

7. The iceboard according to either claim 4 or claim 6, wherein said mounting means comprises, for each skate, a transverse tubular portion in a skate housing and a bushing for receiving said axle therein, said transverse tube having an axial length substantially equal to the axial length of the bushing, and locking means for securing said skate housing to said axle so tht said axle passes through said bushing to permit the skate housing to rotate freely on the bushing and about said axle while preventing the skate housing from moving laterally.

8. In a skateboard of the type which includes a platform and a pair of trucks on the underside of the platform secured to a surface of the platform, each of the trucks including a transversely extending axle secured to a mounting member of said truck, the improvement comprising a group of components for causing said skateboard to act as an iceboard, said group comprising:

a skate, including an ice-engaging runner secured to a skate housing which is structurally adapted for pivotal movement of the skate about said axle and fixed laterally relative to the mounting member of said truck, said skate housing including a transversely-extending tubular portion passing through said skate housing; a bushing having an axial length substantially equal to the axial length of said tubular portion and sized at its interior for receiving said axle therethrough; and means for pivotally securing said skate housing and said bushing to said axle for fixed lateral movement relative to said mounting member and free pivotal movement about said axle, a forward portion of said skate including an upwardly extending protrusion which extends to a height such that the upper terminus of said protrusion engages the underside of said platform before a front portion of said platform engages a surface on which said runner rests.

9. An iceboard as set forth in claim 8, wherein said pivotally-securing means includes a lock washer, a nut, and a self-lubricating washer for interposition on said axle between said mounting member and one side of said bushing; and a self-lubricating washer, a lock washer, and a nut for engaging said axle on the other side of said bushing.

* * * * *